United States Patent [19]

Costa

[11] 4,341,231

[45] Jul. 27, 1982

[54] COSMETIC APPLICATOR AND ASSOCIATED METHOD

[76] Inventor: Allan Costa, 131 Beverly Rd., Huntington, N.Y. 11746

[21] Appl. No.: 156,652

[22] Filed: Jun. 5, 1980

[51] Int. Cl.[2] ..... A45D 40/30

[52] U.S. Cl. ..... 132/88.5

[58] Field of Search ..... 15/167 R, 160; 401/130; 132/88.5, 88.7

[56] References Cited

U.S. PATENT DOCUMENTS

| | | | |
|---|---|---|---|
| 2,011,414 | 8/1935 | Oldham | 401/130 |
| 2,291,676 | 8/1942 | Baker | 401/130 |
| 2,799,882 | 7/1957 | Falk | 401/130 |
| 3,100,309 | 8/1963 | Gambino | 15/167 R |
| 3,325,845 | 6/1967 | Sawkiw | 15/167 R |
| 3,590,414 | 7/1971 | Gores | 15/167 R |
| 3,863,654 | 2/1975 | Morane | 132/88.7 |
| 3,943,592 | 3/1976 | Bhaskar | 15/160 |
| 4,213,472 | 7/1980 | Gueret | 401/130 |

*Primary Examiner*—G. E. McNeill

*Attorney, Agent, or Firm*—Hane, Roberts, Spiecens & Cohen

[57] ABSTRACT

An applicator for mascara eyebrow lotion or the like comprising a handle having a stem at the free end of which is an applicator. The applicator comprises a flexible tape element secured to the stem and carrying a plurality of filaments projecting from the tape element. The filaments are of hook-shape and are oriented randomly on the tape element and they are adapted to hold a quantity of liquid by surface tension of the liquid.

13 Claims, 4 Drawing Figures

COSMETIC APPLICATOR AND ASSOCIATED METHOD

FIELD OF THE INVENTION

The invention relates to a cosmetic applicator particularly for use on eyelashes and eyebrows and especially adaptable for the application of mascara. The invention also relates to associated methods of use with the applicator.

PRIOR ART

Many different types of cosmetic applicators for use on eyebrows and eyelashes are known and these have assumed many different shapes and brush arrangements.

In an earlier patent of mine (U.S. Pat. No. 3,690,777), there is shown the typical arrangement of a brush which is spiral in form and is carried at the end of a rod. Such brush is applicable as a mascara applicator. Also shown in the patent is a narrow brush on a rod suitable for use for application of eye-liner.

Other patents showing typical arrangements of conventional brushes are U.S. Pat. Nos. 2,829,655, 2,990,834, 3,343,551, 3,908,676, 3,921,650, 4,056,111, 4,135,527.

In all of the above, the brush proper is composed of radially extending bristles either in grouped or spiral arrangement.

Although these brushes are generally satisfactory, they have the disadvantage of not being capable of applying the liquid substance to the eyelashes or eyebrows uniformly and they also have the disadvantage of not being able to store a large amount of liquid which requires frequent reintroduction into the liquid reservoir.

SUMMARY OF THE INVENTION

An object of the invention is to provide an applicator which will coat each individual hair of eyelashes or eyebrows substantially uniformly over the entire circumferential extent thereof.

A further object of the invention is to provide an applicator in which the hair will be uniformly coated with a single stroke.

A further object of the invention is that the applicator will hold a substantially greater supply of liquid product which minimizes the re-introduction of the applicator into the liquid reservoir.

Still another object of the invention is to provide an applicator in which the amount of liquid product which is stored is sufficient to permit coating eyelashes in entirety with a single introduction of the applicator into the liquid reservoir.

A further object of the invention is to provide an applicator which prevents smudging of the area around the eyes.

Still another object of the invention is to provide an applicator which is simple in use and which operates on the principle of surface tension of liquids to permit the applicator to store a relatively large amount of liquid after a single introduction into the liquid reservoir.

In accordance with the above and further objects of the invention, there is provided an applicator for a cosmetic liquid which comprises a flexible tape element secured to a stem and carrying a plurality of filaments of hook-shape oriented randomly on the tape.

In accordance with a feature of the invention, the tape element and loop filaments can be constituted by a Velcro member.

According to another feature of the invention, the stem is provided with a longitudinal slot and the tape element is wrapped around the stem with its free ends secured in the slot.

In accordance with the method of the invention, a quantity of cosmetic liquid is held on the flexible hook members by surface tension of the liquid and the liquid is applied to the hair by contacting the hook members and the liquid with the hair to break the surface tension. This can be achieved by a twisting action of the applicator.

DETAILED DESCRIPTION

Figure 1:
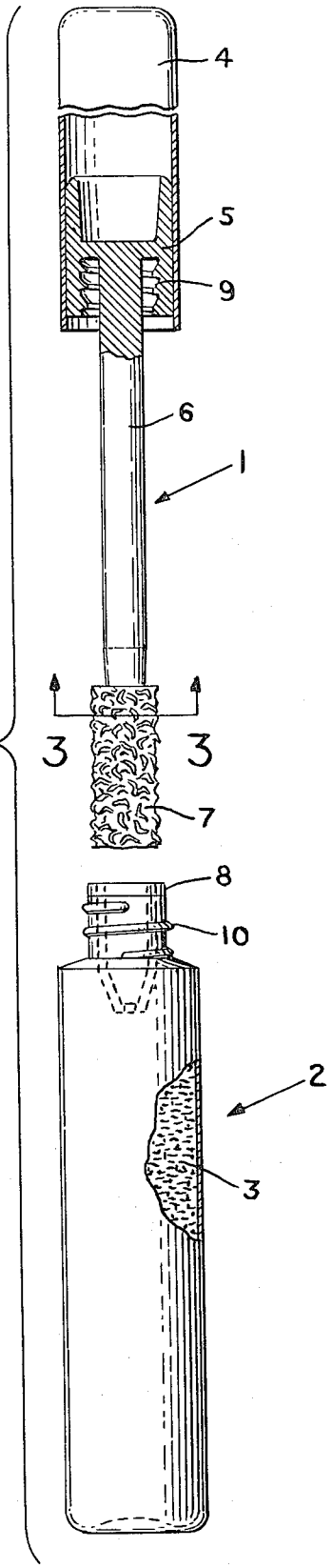
FIG. 1 is a side elevational view partly broken away and in section of a cosmetic unit in which the applicator is removed from the container.
Figure 2:
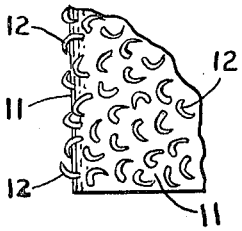
FIG. 2 shows a portion of the applicator on an enlarged scale.
Figure 3:
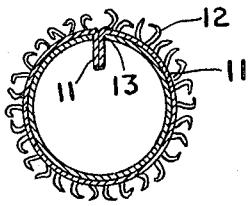
FIG. 3 is a cross-section on enlarged scale taken on line 3—3 in FIG. 1.

In FIG. 1 is seen a cosmetic unit comprising an applicator 1 and a container 2 for a cosmetic liquid 3 adapted for application to the eyelashes or eyebrows of the user. By way of example, the cosmetic liquid 3 may be mascara.

The applicator comprises a handle 4 in the form of a tubular element which tightly engages a hub 5 which carries an integral stem 6. An applicator means 7 for application of the liquid 3 to the eyelashes or eyebrows is mounted on the end of stem 6. In operation, the stem is inserted into the container 2 so that the applicator means 7 will pick-up cosmetic liquid 3 so that upon removal from the container 2, it is ready to apply the liquid to the eyelashes or eyebrows. The container 2 carries a wiper 8 at the end thereof to remove excess liquid from the applicator means 7. The hub 5 has internal threading 9 adapted to cooperate with external threads 10 on the mouth of the container 2 so that, in storage position, the stem 6 is inserted into the container and the threads 9 are threadably engaged with the threads 10 to form a sealed closure with the container.

Up to this point, the construction is conventional. The invention is particularly drawn to the construction of the applicator means 7.

In particular, the applicator means 7 is composed of a substrate 11 having a plurality of filaments 12 projecting therefrom. The free ends of the filaments 12 are formed as hooks to confer a hook-shape to the filaments. The hooks are oriented in random directions on the substrate. The applicator means 7 can be constituted as a tape woven of monofilament nylon in the form of raised and staggered loops. The loops are precisely cut in alternate directions to provide a concentration of hook-shape filaments of the order of 400 hooks per square inch. The tape is sold commercially as Velcro hook tape by Velcro Corporation, New York. The hook members have a relatively low profile and project only about 3 mm from the substrate.

In order to mount the tape on the stem 6, the stem is provided with a slot 13 extending from the free end thereof axially over a length equal to the length of the tape. The tape is wrapped around the stem and its free ends are secured in face-to-face relation within the slot 13. An adhesive can be applied to the rear face of the substrate 11 in order to adhesively join the tape to the stem. According to an alternative method the tape can be secured to the stem by ultrasonic welding.

In another embodiment of the invention, the edges of the tape are welded together to produce a pre-formed sleeve which is slidably mounted on the stem and affixed thereto by an adhesive or ultrasonic welding or the like.

The hook ends of the filaments 12 extend over a minor portion of the axial length thereof but are sufficient to hold a quantity of liquid therein as a droplet by the surface tension of the liquid. As a consequence, a large quantity of liquid can be retained by the applicator for application to the eyebrows or eyelashes of the user. Furthermore, since a quantity of liquid is retained in the hook portion, it becomes possible to completely coat the entire periphery of a hair of the eyebrows or eyelashes by a single stroke with twisting and turning of the applicator. Since there will be a total covering of each hair, a thickening and lengthening of the eyelashes will be obtained in the case of application of mascara. Because of the open loops of the hooks and its ability to carry a large amount of liquid product 3 from the container to the eyelashes or eyebrows, a coating of the entire eyelashes can be obtained with a single dipping of the applicator into the container. This avoids reinsertion of the applicator in and out of the container as in ordinary constructions. In effect, each hook element supports a droplet of liquid at the free hook end which is retained by surface tension and the liquid is applied to the hair by contacting the hook members and the liquid with the hair to break the surface tension. When this is effected by a twisting action, the entire circumferential surface of the hair is contacted by the liquid so as to be completely coated thereby. This is effective for curling eyelashes in the case of application of liquid to eyelashes.

Figure 4:
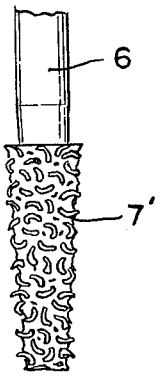
FIG. 4 shows a portion of an applicator according to a modification thereof.

Although the invention has been described in conjunction with a specific embodiment thereof, numerous modifications and variations will become evident to those skilled in the art without departing from the scope and spirit of the invention. Thus, for example, although a straight stem has been illustrated, it can be made in any shape or length and, by way of example, it can be curved, tapered in one or two directions or modified in other respects. Additionally, although the applicator means 7 has been shown as cylindrical in shape in FIG. 1, it can be tapered to be conical as shown in FIG. 4 at 7' or of any other suitable shape.

What is claimed is:

1. In an applicator for a liquid such as mascara, eyebrow lotion or the like comprising a handle, a stem attached to the handle and applicator means on said stem, the improvement wherein said applicator means comprises a flexible tape element formed as an annulus secured to said stem and including a plurality of filaments projecting from said tape element, said filaments being of hook shape and oriented randomly on said tape element, said flexible tape element surrounding said stem such that said filaments project substantially radially from said stem substantially entirely therearound, said filaments having opposite ends, one of said ends being secured to said tape element, the other end of the filament being shaped as a hook to form the hook shape for the filament, said hook being dimensioned and proportioned to constitute a means for holding a droplet of liquid by surface tension of the liquid and for applying the liquid to the hair by contacting the hook holding the liquid droplet to said hair to break the surface tension.

2. The improvement as claimed in claim 1 wherein said tape element and filaments are VELCRO.

3. The improvement as claimed in claim 1 wherein said stem is round.

4. The improvement as claimed in claim 1 wherein said stem is provided with a longitudinal slot, said tape element having free ends and being wrapped around said stem with said free ends secured in said slot.

5. The improvement as claimed in claim 4 wherein said free ends are secured in said slot in face-to-face relation.

6. The improvement as claimed in claim 5 wherein said stem has a free end, said slot extending longitudinally in said stem from said free end.

7. The improvement as claimed in claim 5 wherein said filaments are of uniform height.

8. The improvement as claimed in claim 1 wherein said flexible tape element is a pre-formed sleeve mounted on said stem.

9. A method as claimed in claim 1 wherein the contact of the hook members and liquid droplets with the hair to break the surface tension is effected by a twisting action.

10. The improvement as claimed in claim 1 wherein said stem is conical in shape.

11. A method of applying liquid to the hair of lashes and brows of a person's eye comprising providing a flexible tape member of Velcro having flexible hook members extending radially from said tape member, forming said tape member as an annulus secured on a stem of a holder to extend around said stem with the annulus thereon, immersing the stem into a cosmetic liquid, withdrawing the stem from the liquid whereupon droplets of the liquid are held by the flexible hook members at hook ends thereof by surface tension of the liquid and applying the liquid to the hair by contacting the hook members holding the liquid droplets with the hair to break the surface tension.

12. A method as claimed in claim 11 wherein the flexible tape member is formed as a sleeve installed on said stem.

13. The improvement as claimed in claim 7 wherein said filaments are distributed uniformly around said stem.

* * * * *